US006205680B1

(12) United States Patent
Clark

(10) Patent No.: US 6,205,680 B1
(45) Date of Patent: Mar. 27, 2001

(54) SELF-VENTILATING FOOTWEAR

(75) Inventor: Gregory Clark, Weston, CT (US)

(73) Assignee: Breeze Technology, Las Vegas, NV (US)

( * ) Notice: Subject to any disclaimer, the term of this patent is extended or adjusted under 35 U.S.C. 154(b) by 0 days.

(21) Appl. No.: 09/268,990

(22) Filed: Mar. 16, 1999

(51) Int. Cl.[7] ..... A43B 7/08
(52) U.S. Cl. ..... 36/3 B; 36/29
(58) Field of Search ..... 36/3 B, 3 R, 29

(56) References Cited

U.S. PATENT DOCUMENTS 3,225,463 * 12/1965 Burnham .
3,791,051 * 2/1974 Kamimura .
5,138,775 * 8/1992 Chu .
5,515,622 * 5/1996 Lee .
5,606,806 * 3/1997 O'Dwyer .
5,697,170 * 12/1997 Murrell et al. .
5,950,332 * 9/1999 Lain .

FOREIGN PATENT DOCUMENTS

2627960 * 9/1989 (FR) .

* cited by examiner

*Primary Examiner*—Ted Kavanaugh
(74) *Attorney, Agent, or Firm*—Shaw Pittman

(57) ABSTRACT

Self-ventilating footwear using two simple check valves attached to a midsole insert that comprises a compression member and a displacement compartment, wherein the midsole insert is inserted into the lower part of a shoe. The check valves are located on the forefoot and heel of the shoe and operate by compression of the user's foot which forces air out of the heel valve and, in turn, creates a vacuum in the displacement compartment which draws air in through the forefoot valve. By walking or running, the user repeatedly compresses the displacement compartment and drives the airflow through the displacement compartment. The simple nature of the valve and compartment arrangement improves the ease of manufacture and reduces the cost of the footwear.

18 Claims, 4 Drawing Sheets

SELF-VENTILATING FOOTWEAR

The present application claims priority from the filing date of the provisional patent application Ser. No. 60/078,176 filed Mar. 16, 1998, entitled "Self-Ventilating Footwear".

BACKGROUND

1. Field of the Invention

The present invention relates to self-ventilating footwear.

2. Background of the Invention

The present invention is a modification of the self-ventilating footwear disclosed in U.S. Pat. No. 5,606,806 (the "'806 patent"), which is incorporated by reference herein. The modifications were made to improve the ease of manufacture of the footwear. The present invention incorporates two one-way check valves, an air pocket with a volume of about four cubic inches in the mid-sole, and ensures that the mid-sole of the footwear is structurally sound and stable.

SUMMARY OF THE INVENTION

The present invention uses two members that are layered one on top of the other. We will call the bottom member the "compression member" and the top member the "displacement compartment." The compression member allows for stability and cushioning and the displacement compartment is designed to flatten one hundred percent displacing an air volume of approximately four cubic inches. The upper and lower members are designed into a single unit that can be sandwiched into the mid-sole component of an athletic shoe. The mid-sole that the single unit is nested into is generally an EVA material of 50–60 durometer. The total compression of the total composite outsole should be limited to 60%.

One of the advantages of this design/construction is that it enables the displacement compartment to be valved independently from the compression member. Depending on manufacturing methods, the compression member could be filled with pressurized gas, polymer gel, or other resilient structures such as foam, flexible polymer honeycomb. The compression member can be designed numerous ways taking into consideration that, when compressed, the air is controlled within the member and does not distort the function of the shoe. For example, jumping on an inflated raft as you compress one end, the person on the other end is thrown into the air. A dynamic such as this from rear foot to fore foot is not desirable. Methods for limiting this effect would be welded-in ribs where the top surface and bottom surface are sealed together, essentially kissing off smaller compartments within the complete compression member. These kiss-offs can be laid out in many ways, depending on the specific goals of the design.

For the displacement compartment, the simplest valving design consists of two one-way flapper valves: 1) in the forefoot; and 2) in the heel. As disclosed in the '806 patent, the forefoot valve allows air to pass through it from the shoe into the displacement compartment. This valve consists of a hole through the top layer of the displacement compartment, under which hole and inside the displacement compartment is attached a piece of polymer film welded 270° around the hole. When the displacement compartment is pressurized, the valve seals itself shut. When there is a vacuum created, due to total displacement of the air in the displacement compartment, the valve is sucked open, pulling air from the shoe into the displacement compartment.

As disclosed in the '806 patent, the heel area valve allows air to evacuate from the displacement compartment. This valve could be configured as a pinch valve or flapper valve. In the case of a pinch valve, when the displacement compartment is flattened, air forces it open and as the displacement compartment attempts to reconfigure itself to its normal shape, the valve shuts. The rear exhaust valve could also be engineered to have a positive shut-off that enables the user to eliminate the cooling effect of the airflow if desired. This would be a more mechanical valve with a polymer material sandwiched into a valve housing.

Another advantage of this design over the design disclosed in the '806 patent is that the exhaust valve can be incorporated into the composite outsole construction. This approach is consistent with current shoe manufacturing practices. The '806 patent shows a tubular vent that would be incorporated into the upper with air evacuating towards the top edge of the shoe. However, the present invention uses a simplified shoe construction, making it possible for the lower part of the footwear to be unitized and attached to any number of different upper footwear designs. Although the present invention may be more susceptible to clogging than the '806 patent's tubular vent, because it is an exhaust port, air is forced out through the valve, making it self-cleaning. This solution also offers the option of being able to maintain trade secret on construction by having uppers made in the Orient and composite soles made in the United States.

The suggested manufacturing methods include a blow-molded compression member with a heat-sealed separate top layer welded to a flange to create the displacement compartment. Alternately, the design can also be executed by having three separate plastic sheets, each one thermoformed or formed to suit the function of each individual layer, with all welded together with a single flange. The blow-molded design is easier to execute, but would eliminate the option of inserting any additional compression materials into the compression member.

DETAILED DESCRIPTION OF THE INVENTION

Figure 1:
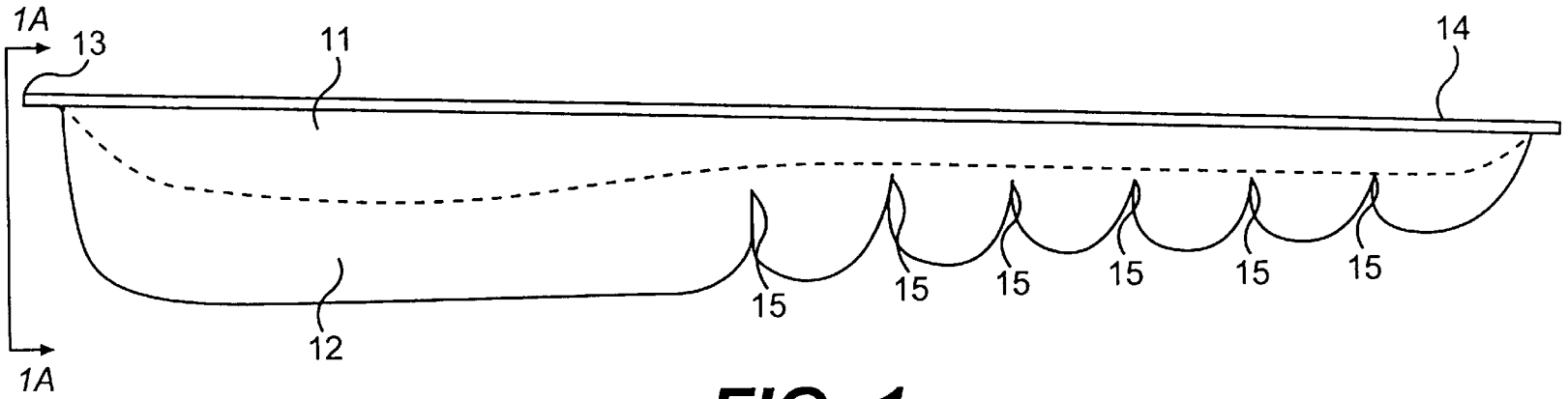
FIG. 1 is a schematic side view of a of the midsole insert of the present invention.
Figure 1A:
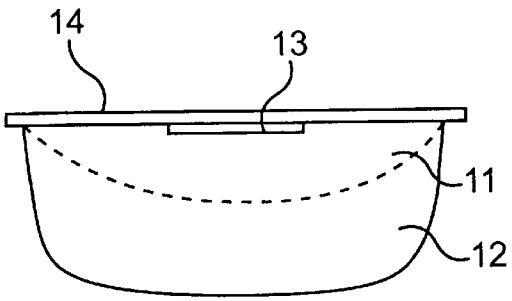
FIG. 1A is a back view of the midsole insert shown in FIG. 1.

Referring to FIGS. 1–4, the primary components of the self-ventilating footwear are a displacement compartment 11, a compression member 12, a top layer 14, an EVA midsole 41, and an outsole 42. The front of the top layer 14

11 has a forefoot valve 22 and the rear of the compression member 12 has a heel valve 21. The compression member 12 has welded-in ribs 15. Point 23 indicates the heal or rear area of the displacement compartment 11. Point 28 indicates the forefoot area of the displacement compartment 11.

The forefoot valve 22 allows air to pass through it in only one direction, from outside of the displacement compartment 11 to inside the displacement compartment 11. The air enters the forefoot valve 22 through the hole 25. This forefoot valve 22 consists of a piece of polymer film 27 welded 270° around the underside of the hole 25 to the top layer 14, so that the polymer film resides on the underside of the top layer 14. The unwelded portion of the polymer film 27 creates an opening 26 through which the air enters displacement compartment 11. When the displacement compartment 11 is pressurized, the forefoot valve 22 seals itself shut. When there is a vacuum created, due to total displacement of the air in the displacement compartment 11, the forefoot valve 22 is sucked open, pulling air from outside the displacement compartment 11 into the displacement compartment 11.

The heel valve 21 allows air to pass through it in only one direction, from inside the displacement compartment 11 to outside the displacement compartment 11. When the user compresses the shoe bottom the air within the displacement compartment is forced out through the heel valve 21.

Figure 2:
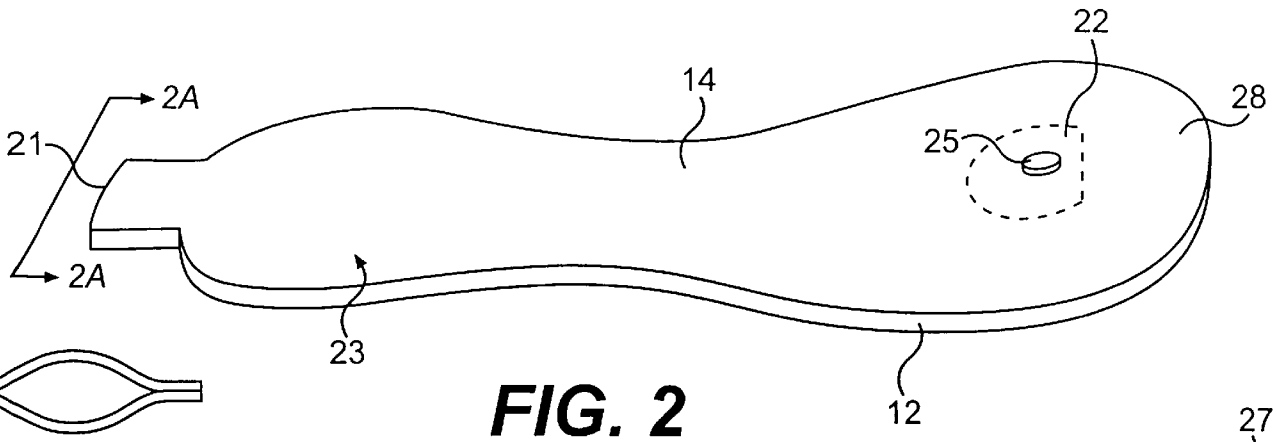
FIG. 2 is a schematic of the midsole insert.
Figure 2A:
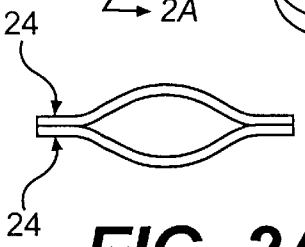
FIG. 2A is a schematic of a pinch-type heel valve.
Figure 2B:
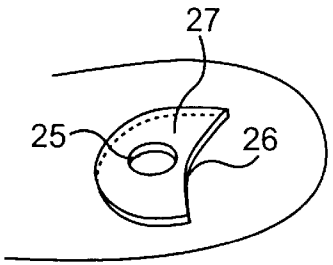
FIG. 2B is a schematic of the forefront valve of the midsole insert.

In the preferred embodiment, the heel valve 21 is configured as a pinch valve as shown in FIG. 2A. When the displacement compartment 11 is flattened, air forces the pinch valve 24 open and as the displacement compartment reconfigures to its normal shape, the pinch valve 24 shuts.

Figure 3:
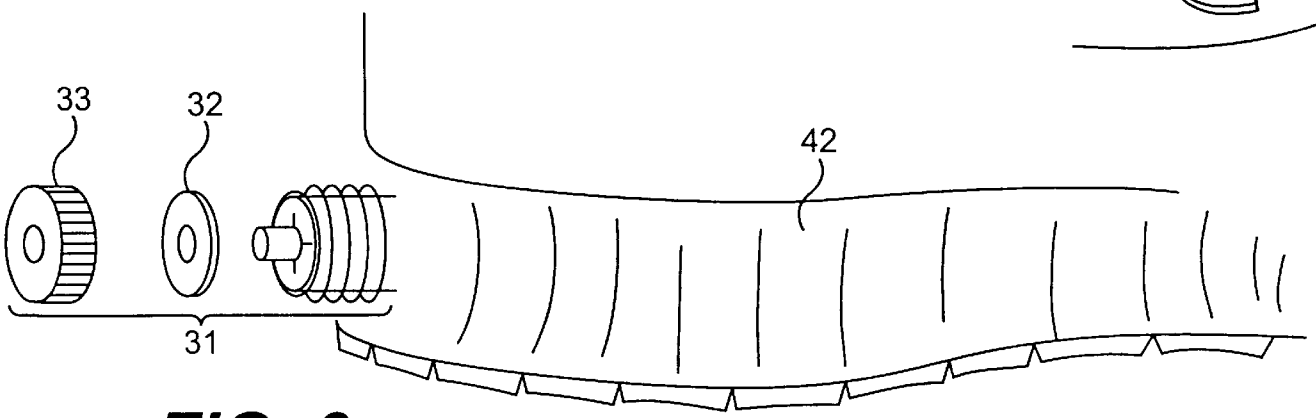
FIG. 3 is an exploded view of a flapper-type heel valve.
Figure 4:
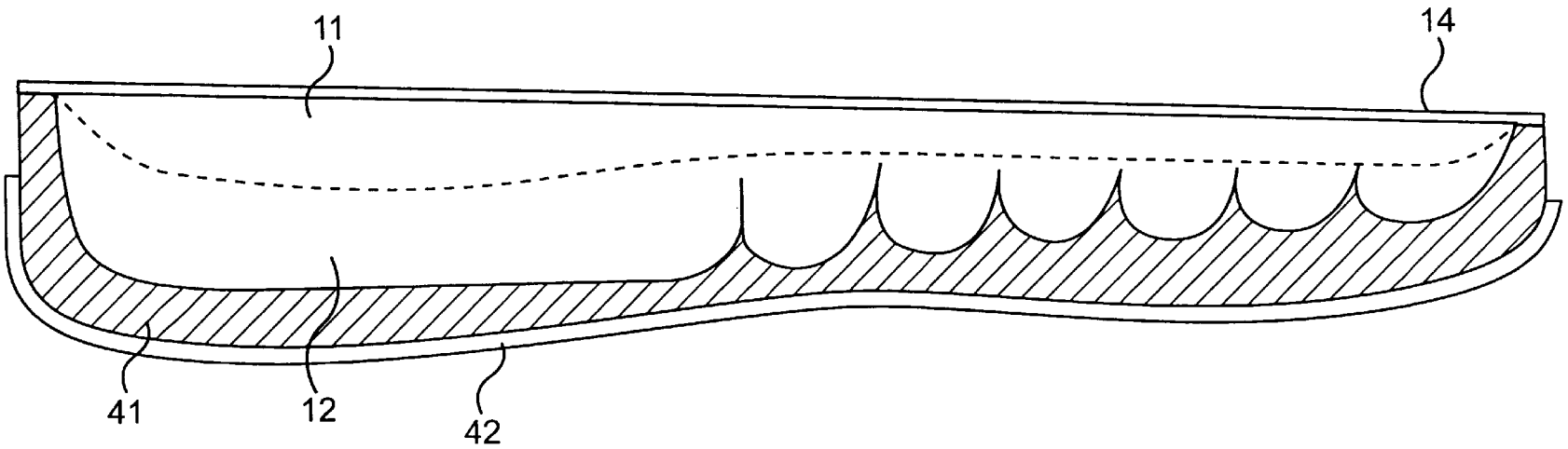
FIG. 4 is a schematic of a lower part of a shoe incorporating the midsole insert.

The heel valve 21 could also be a flapper valve 31, as shown in FIG. 3. This flapper valve 31 uses a screw cap 33 on top of a flapper 32 to open and close the flapper valve 31. Thus, the user can close the flapper valve 31 to eliminate the cooling effect of the airflow if desired.

The heel valve 31 can be incorporated into the outsole 42 as shown in FIG. 3. The heel valve 31 allows air inside displacement compartment 11 to exit through midsole 41 and outsole 42.

Figure 5A:
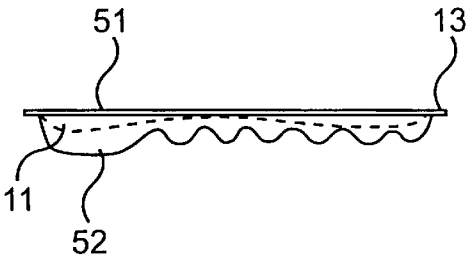
FIG. 5A is the side view of a blow-molded midsole insert shown in FIG. 5.
Figure 6A:
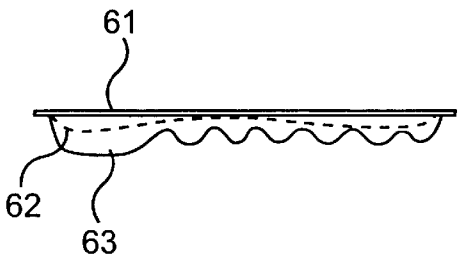
FIG. 6A is the side view of a layered midsole insert shown in FIG. 6.
Figure 5:
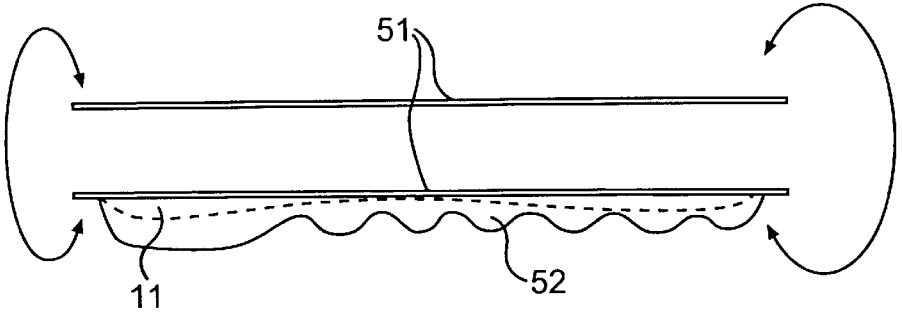
FIG. 5 is an exploded view of a blow-molded midsole insert.
Figure 6:
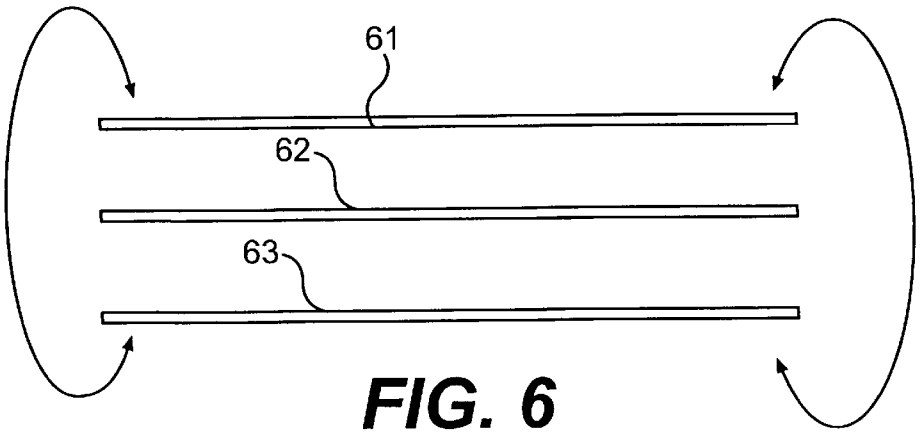
FIG. 6 is an exploded view of a layered midsole insert.

FIGS. 5–6A illustrate two examples of ways in which the midsole insert of the present invention comprising displacement compartment 11 and compression member 12 can be manufactured. In the preferred embodiment of the present invention, FIG. 5 shows a blow-molded compression member 52 with a heat-sealed separate top layer 51 on a flange 13 to create the displacement compartment 11. FIG. 5A shows the blow-molded compression member 52 joined with the heat-sealed separate top layer 51.

As another embodiment of the present invention, FIG. 6 shows a layered compression member in which a sheet stock 61 is welded to a first preformed sheet stock 62 and a second preformed sheet stock 63 to form the displacement compartment 11. FIG. 6A shows the completely assembled layered midsole insert.

What is claimed is:

1. A self-ventilating footwear having a midsole, the footwear comprising:

(a) a midsole insert nested in the midsole, wherein the midsole insert comprises a compression member and a top layer having an underside, wherein the top layer and the compression member define a displacement compartment;

(b) a first check valve embedded in the top layer, wherein the first check valve comprises a hole through the top layer and a polymer film welded around the hole on the underside of the top layer, leaving an opening between the polymer film and the top layer; and (c) a second check valve embedded in the midsole insert, wherein when the underside of the top layer comes into contact with the compression member, the polymer film closes the hole of the first check valve and the air exits the displacement compartment through the second check valve, and wherein when the underside of the top layer separates from the compression member, fresh air enters the displacement compartment through the opening between the polymer film and the top layer.

2. The footwear of claim 1, wherein the polymer film is welded 270° around the hole and an unwelded portion of the polymer film defines the opening.

3. The footwear of claim 1, wherein the compress ion member comprises a top surface and a bottom surface, wherein the top surface and the bottom surfaces have kiss-offs in plurality of locations to form ribs on the compression member.

4. The footwear of claim 1, wherein the midsole insert comprises a forefoot area and a heel area, and wherein the first check valve is located near the forefoot area and the second check valve is located near the heel area.

5. The footwear of claim 1, wherein the compression member is blow-molded.

6. The footwear of claim 1, wherein the top layer is heat-sealed to the compression member on a flange to create the displacement compartment.

7. The footwear of claim 1, wherein the top layer is made of a sheet stock, wherein the compression member comprises a first preformed sheet stock and a second preformed sheet stock, and wherein the sheet stock, the first preformed sheet stock, and the second preformed sheet stock are welded together with a single flange.

8. The footwear of claim 7, wherein one or more of the sheet stock, the second preformed sheet stock, and the second preformed sheet stock are made of thermo-formed plastic.

9. A midsole insert for a self-ventilating footwear, the midsole insert comprising:

(a) a blow-molded compression member having ribs formed by a plurality of kiss-offs between a top surface and a bottom surface of the compression member;

(b) a top layer attached to the compression member to a flange, wherein the top layer has an underside, and wherein the compression member and the top layer define a displacement compartment that contains air;

(c) a forefoot valve embedded in a forefoot area of the top layer, wherein the forefoot valve comprises a hole through the top layer and a polymer film welded around the hole on the underside of the top layer, leaving an opening between the polymer film and the top layer; and (d) a heel valve embedded in a heel area of the midsole insert, wherein when the underside of the top layer comes into contact with the top surface of the compression member, the polymer film closes the hole of the forefoot valve and the air exits the displacement compartment through the heel valve, and wherein when the underside of the top layer separates from the compression member, fresh air enters the displacement compartment through the opening between the polymer film and the underside of the top layer.

10. The midsole insert of claim 9, wherein the polymer film is welded 270° around the hole and an unwelded portion of the polymer film defines the opening.

11. The midsole insert of claim 9, wherein the heel valve is one of a pinch valve and a flapper-type valve.

12. The midsole insert of claim 9, wherein the top layer is heat-sealed to the compression member on the flange.

13. A method for making the midsole insert of claim 9, the method comprising the steps of:

(a) preparing the top layer having the underside the forefoot area;

(b) creating the hole on the top layer in the forefoot area;

(c) welding the polymer film around the hole on the underside of the top layer, leaving the opening between the polymer film and the top layer;

(d) forming the ribbed compression member; and (e) attaching the top layer to the compression member on the flange to create the displacement compartment.

14. The method of claim 13, wherein the top layer is made of a sheet stock.

15. The method of claim 13, wherein the top layer is welded to the compression member on the flange.

16. The method of claim 13, further comprising the steps of forming the compression member by welding together a first preformed sheet stock and a second preformed sheet stock, and wherein the top layer, the first preformed sheet stock, and the second preformed sheet stock are welded together to form the flange.

17. The method of claim 13, wherein one or more of the sheet stock, the second preformed sheet stock, and the second preformed sheet stock are made of thermo-formed plastic.

18. The method of claim 13, wherein the compression member is blow-molded.

* * * * *